US010605013B2

(12) United States Patent
Gosney

(10) Patent No.: US 10,605,013 B2
(45) Date of Patent: Mar. 31, 2020

(54) CASING STRING ASSEMBLY WITH COMPOSITE PRE-MILLED WINDOW

(71) Applicant: Halliburton Energy Services, Inc., Houston, TX (US)

(72) Inventor: Jon Troy Gosney, Bellville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 79 days.

(21) Appl. No.: 15/758,388

(22) PCT Filed: Oct. 23, 2015

(86) PCT No.: PCT/US2015/057130
§ 371 (c)(1),
(2) Date: Mar. 8, 2018

(87) PCT Pub. No.: WO2017/069774
PCT Pub. Date: Apr. 27, 2017

(65) Prior Publication Data

US 2018/0266192 A1 Sep. 20, 2018

(51) Int. Cl.

| | |
|---|---|
| ***E21B 17/10*** | (2006.01) |
| ***E21B 41/00*** | (2006.01) |
| ***E21B 7/06*** | (2006.01) |
| ***E21B 7/20*** | (2006.01) |

(52) U.S. Cl.
CPC ..... *E21B 17/1042* (2013.01); *E21B 7/06* (2013.01); *E21B 7/20* (2013.01); *E21B 41/0035* (2013.01)

(58) Field of Classification Search
CPC ..... E21B 17/1042; E21B 7/06; E21B 7/20; E21B 41/0035; E21B 29/06; E21B 7/061; E21B 17/00
See application file for complete search history.

(56) References Cited

U.S. PATENT DOCUMENTS

| | | | |
|---|---|---|---|
| 3,864,093 | A | 2/1975 | Wolfla |
| 4,410,598 | A | 10/1983 | Kuzel et al. |
| 4,431,069 | A | 2/1984 | Dickinson et al. |
| 4,578,114 | A | 3/1986 | Harrington et al. |
| 4,961,994 | A | 10/1990 | Harris, Jr. et al. |
| 5,338,577 | A | 8/1994 | Burdette et al. |
| 5,615,740 | A | 4/1997 | Comeau et al. |
| 5,942,333 | A | 8/1999 | Arnett et al. |

(Continued)

FOREIGN PATENT DOCUMENTS

| | | | | |
|---|---|---|---|---|
| EP | 186317 | | 7/1986 | |
| WO | WO 2015069269 | * | 5/2015 | ..... E21B 29/08 |

OTHER PUBLICATIONS

International Patent Application No. PCT/US2015/057130 , "International Search Report and Written Opinion", dated Jul. 26, 2016, 13 pages.

(Continued)

*Primary Examiner* — Yong-Suk Ro
(74) *Attorney, Agent, or Firm* — Kilpatrick Townsend & Stockton LLP

(57) ABSTRACT

Casing string assemblies used in oil wells, as well as methods for producing them include a composite pre-milled window that provides mechanical protection but is easily drillable or millable without the need to remove unwanted debris or internal sleeves, and is especially suitable for multilateral well technology.

19 Claims, 7 Drawing Sheets

(56) References Cited

U.S. PATENT DOCUMENTS

| | | | |
|---|---|---|---|
| 6,012,526 | A | 1/2000 | Jennings et al. |
| 6,206,111 | B1 | 3/2001 | Nistor |
| 6,923,273 | B2 | 8/2005 | Terry et al. |
| 7,082,998 | B2 | 8/2006 | Zamora et al. |
| 7,090,894 | B2 | 8/2006 | Carper et al. |
| 7,703,524 | B2 | 4/2010 | Parlin |
| 7,726,401 | B2 | 6/2010 | Parlin et al. |
| 7,998,593 | B2 | 8/2011 | Mahoney et al. |
| 2004/0168807 | A1 | 9/2004 | Mcglothen et al. |
| 2007/0193736 | A1 | 8/2007 | Corre et al. |
| 2007/0289735 | A1 | 12/2007 | Corre et al. |
| 2008/0099201 | A1 | 5/2008 | Sponchia et al. |
| 2011/0220348 | A1 | 9/2011 | Jin et al. |
| 2011/0226467 | A1 | 9/2011 | Hepburn et al. |
| 2011/0253244 | A1 | 10/2011 | Lord et al. |
| 2012/0090720 | A1 | 4/2012 | Burrowes et al. |
| 2012/0145463 | A1 | 6/2012 | Lee et al. |
| 2012/0155813 | A1 | 6/2012 | Quigley et al. |
| 2014/0008130 | A1 | 1/2014 | Dancer et al. |

OTHER PUBLICATIONS

Zimmer , "New Graphene Super Paper is 10x Stronger Than Steel", Available online at http://inhabitat.com/new-graphene-super-paper-is-10x-stronger-than-steel/, Apr. 20, 2011, 2 pages.

* cited by examiner

CASING STRING ASSEMBLY WITH COMPOSITE PRE-MILLED WINDOW

TECHNICAL FIELD

The present disclosure relates generally to an assembly for subterranean fluid production and, more particularly (although not necessarily exclusively), to an assembly that includes a composite material disposed over an opening of an assembly body, where milling the member is easier than milling the body. It is also related to methods for producing the assemblies.

BACKGROUND

Hydrocarbons may be removed from a subterranean formation by drilling a wellbore traversing the subterranean formation. The wellbore may be complex and may include, for example, multilateral wellbores and sidetrack wellbores. A multilateral wellbore includes one or more secondary wellbores that extend from a parent (or main) wellbore, while a sidetrack wellbore can include a main wellbore in a first direction and a secondary wellbore diverted from the main wellbore in a second general direction. Accordingly, a casing string assembly within one of these complex wellbores may include a window or opening in the wall of a casing to allow intersecting wellbores, such as a lateral wellbore or a sidetrack wellbore, to be formed. The window may be pre-milled or otherwise created before the casing string assembly is positioned in the wellbore. Casing with pre-milled windows are used to reduce or eliminate debris during the drilling process. The pre-milled window must be protected prior to drilling.

BRIEF DESCRIPTION OF THE DRAWINGS

The accompanying drawings, which are included to provide a further understanding of the inventive technology and are incorporated in and constitute a part of this specification, illustrate various embodiments of the inventive technology and together with the description serve to explain the principles and concepts of the technology. In the drawings.

Figure 1:
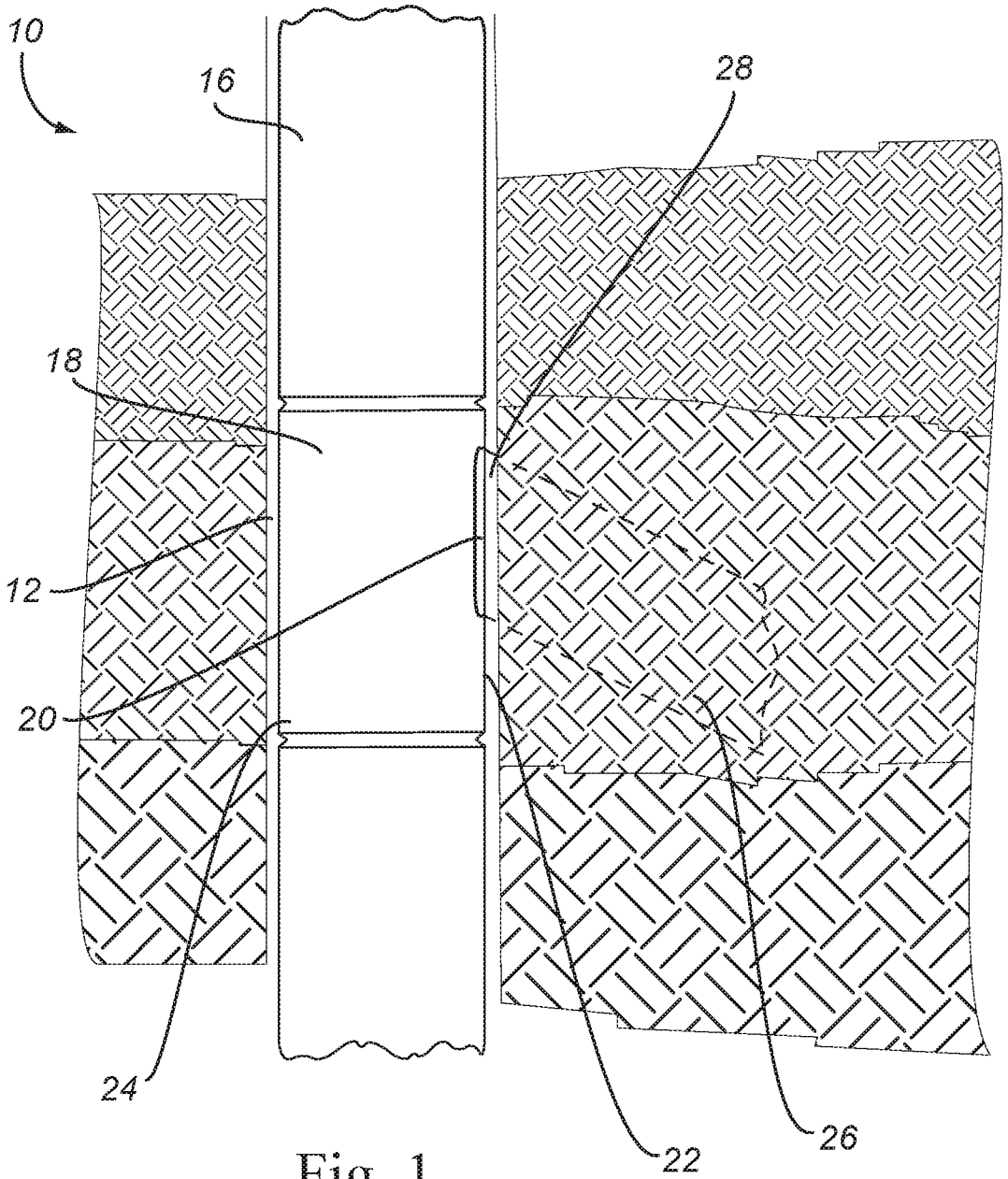
FIG. 1 is a schematic cross-sectional illustration of a well system having an assembly with a window through which a branch wellbore can be created according to one embodiment of the present disclosure.

The figures referred to above are not drawn necessarily to scale and should be understood to present a representation of an embodiment and to illustrate the principles involved. Some features of the casings depicted in the drawings have been enlarged or distorted relative to others to facilitate explanation and understanding. The same reference numbers are used in the drawings for similar or identical components and features shown in various alternative embodiments. Casings, as disclosed herein, will have configurations and components determined, in part, by the intended application and environment in which they are used.

DETAILED DESCRIPTION

The disclosure is directed to casing and casing string assemblies with pre-milled windows that are protected during placement in the wellbore but are easily drillable/millable, without the need to remove unwanted debris or internal sleeves. Certain aspects of the present disclosure relate to assemblies capable of being disposed in a bore, such as a wellbore, of a subterranean formation. An assembly described herein optionally includes a composite covering on a pre-milled window, which is an opening in a wall of a body, such as a casing. The composite covering for the pre-milled window protects the casing during placement in the wellbore but is easily drillable/millable, without the need to remove unwanted debris or internal sleeves.

Various embodiments of the disclosed assemblies can be used to support a pre-milled window in a parent wellbore prior to a branch wellbore being created through the pre-milled window. As used herein, "parent wellbore" or "main wellbore" is a wellbore from which another wellbore is drilled. A parent or main wellbore does not necessarily extend directly from the earth's surface. For example, it could be a branch wellbore of another parent wellbore. As used herein, a "multilateral wellbore" is a single wellbore with one or more vertical, inclined, or horizontal branch wellbores radiating from the parent or main borehole As used herein, a "branch wellbore" is a wellbore drilled outwardly from its intersection with a parent wellbore. Examples of branch wellbores include a lateral wellbore and a sidetrack wellbore. A branch wellbore can have another branch wellbore drilled outwardly from it such that the first branch wellbore is a parent wellbore to the second branch wellbore.

The casing assemblies described herein include pre-milled windows that are protected during placement in the well-bore but are easily drillable/millable without the need to remove unwanted debris or internal sleeves. The casing assemblies described herein include a tubular casing having a pre-milled window in a wall of the casing. The pre-milled window is covered by a material that may surround the perimeter of the casing along a length sufficient for the material to cover the pre-milled window and at least part of the outer surface of the casing string wall. The covering over the pre-milled window preferably has a thickness that permits its facile use in the casing string assembly, especially in conjunction with the use of the wear sleeve, with such thicknesses apparent to those skilled in the art.

Optionally, the covering over the pre-milled window is a composite material that includes layers of cured elastomer, aramid fiber, and/or nylon. Optionally, the composite material includes one or more layers of each of the cured elastomeric rubber and aramid fiber. Optionally, the composite material includes one or more layers of nylon. Optionally, the composite material includes one or more layers of a graphene. As used herein a layer of an individual material (e.g., elastomer) within the composite material refers to that portion of the composite material that is formed from that individual material. The individual material itself may be formed from several sub-layers. For example, if the elastomeric material is wrapped around a tubular casing multiple times, or if small portions of the elastomeric material are otherwise applied incrementally to build up thickness, the elastomeric material will include several sub-layers, but may be referred to herein as one elastomeric layer. The composite material used to protect the pre-milled window is prepared in a way to insure that it does not collapse into the pre-milled window during preparation.

Suitable curable elastomeric rubbers for use in the casing assembly include, but are not limited to, unsaturated elastomeric rubbers and saturated elastomeric rubbers. Unsaturated elastomeric rubbers include natural polyisoprene: cis-1,4-polyisoprene natural rubber and trans-1,4-polyisoprene gutta-percha; synthetic polyisoprene; polybutadiene; chloroprene rubber, polychloroprene, and the like; butyl rubber (copolymer of isobutylene and isoprene); halogenated butyl rubbers (chloro butyl rubber; bromo butyl rubber); styrene-butadiene rubber (copolymer of styrene and butadiene); nitrile rubber (copolymer of butadiene and acrylonitrile), also called Buna N rubbers; hydrogenated nitrile rubbers; and combinations thereof. Saturated elastomeric rubbers include: EPM (ethylene propylene rubber, a copolymer of ethylene and propylene) and EPDM rubber (ethylene propylene diene rubber, a terpolymer of ethylene, propylene and a diene-component); epichlorohydrin rubber; polyacrylic rubber; silicone rubber; fluorosilicone rubber; fluoroelastomers; perfluoroelastomers; polyether block amides; chlorosulfonated polyethylene; ethylene-vinyl acetate; and combinations thereof.

Fluorocarbon elastomers include copolymers of hexafluoropropylene (HFP) and vinylidene fluoride (VDF or VF2), terpolymers of tetrafluoroethylene (TFE), vinylidene fluoride (VDF) and hexafluoropropylene (HFP), as well as perfluoromethylvinylether (PMVE) containing copolymers. Fluorocarbon elastomers are preferred.

Suitable nylon for use in the casing assemblies and methods include, but are not limited to, any aliphatic polyamides such as nylon-6,6; nylon-6; nylon-6,9; nylon-6,10; nylon-6,12, nylon 10,12; nylon-11; nylon-12; and nylon-4,6. Optionally, a nylon layer includes a woven cloth, strip, or tape. In certain embodiments, a first nylon layer includes nylon cloth. In certain embodiments, a second nylon layer includes nylon cloth. In certain embodiments, a third nylon layer includes nylon cloth.

Suitable aramid fibers for use in the casing assemblies and methods include meta-aramid and para-aramid synthetic fibers. Para-aramid synthetic fibers are preferred. The aramid fibers may be used in any form or diameter, with twine being preferred for ease of use in the producing the aramid fiber layer.

In certain embodiments, a first aramid fiber layer may include twine wound around the first cured elastomeric rubber layer or on a first nylon layer, if present. In certain embodiments, the first aramid fiber layer may include twine wound at about 3/16 inch to about 1/4 inch pitch.

In certain embodiments, the second aramid fiber layer includes twine wound around the second cured elastomeric rubber layer or on the second nylon layer, if present. In certain embodiments, the second aramid fiber layer includes twine wound at about 3/16 inch to about 1/4 inch pitch. In certain embodiments, the twine in the second aramid fiber layer is wound substantially perpendicular to the twine in the first second aramid fiber layer.

In certain embodiments, the composite material further includes at least one graphene layer at least partially covering the pre-milled window. Optionally, the graphene layer may be in the form of graphene paper or nanopaper. The graphene layer may be present anywhere in the composite material. Optionally, one or more graphene layers, may be located under and/or over the first cured elastomeric layer, under and/or over the second cured elastomeric layer, and/or under and/or over the third cured elastomeric layer. When at least one graphene layer is present, the composite material may or may not include a nylon layer. When present, the graphene layer provides mechanical strength, such as tensile strength, while still permitting puncturing with the drill bit or other cutting tool during the drilling process. The presence of the graphene layer assists in creating a pressure seal between the inner and outer body of the pre-milled window in addition to improving the structural integrity of the window.

Optionally, any of the casing string assemblies described above further include a wear sleeve disposed on the outer surface of the tubular casing, wherein the wear sleeve includes fiberglass, plastic, or combinations thereof. Optionally, the wear sleeve may include graphene embedded in the fiberglass.

In any of the foregoing casing assemblies, if included, the wear sleeve may cover a portion of the composite material, and covers the pre-milled window. If the wear sleeve includes graphene, the graphene may optionally be embedded around the complete circumference of the sleeve or may optionally be embedded in such a fashion as to leave open the area over the pre-milled window.

Any casing string assembly described herein, optionally may include a wear sleeve over the pre-milled window. Optionally, the wear sleeve may be fastened to the tubular casing. For example, a casing string assembly may include tabs on one or both ends of the wear sleeve to prevent the wear sleeve from rotating. The length and number of tabs, if any, on the wear sleeve may be modified to match the requirements of the pre-milled window. Selecting the length and number of tabs is well within the knowledge and skill of a person having ordinary skill in the art. As other examples, the wear sleeve may be fastened to the casing string using epoxy, latching dogs, screws, rivets, rubber and/or nylon wrapping, heat shrink, or any other fastener known in the art. Accordingly, any method described herein may further include installing a wear sleeve. Optionally, the method also includes installing one or more fasteners (e.g., epoxy, one or more o-rings, latching dogs, screws, rivets, wrappings, heat shrink, or any other fastener known in the art.

Optionally, any of the assemblies described herein may include any binder as described herein on the outer surface of the casing to increase adhesion between the composite material and the casing or wear sleeve. When present, the binder optionally may contact any composite material, wear sleeve, and/or fastener. The binder may prevent leaking of fluids between the inner bore and the annulus around the casing string.

Any binder known in the industry may be used. In embodiments, however, the binder may include a composite metal oxide, metal carbide, metal nitride, metal boride, metal fluoride or mixtures thereof. The metal oxide, metal carbide, metal nitride metal boride, and/or metal fluoride may be present in the binder material in amounts of 20% to 100% (e.g. 20% to 99%, 50% to 99%, 60% to 99%, 70% to 99%, 80% to 99%, 90% to 99%) by weight of the binder material. The metal oxide may be a metal oxide mixture (e.g., titanium oxide, aluminum oxide, or a mixture thereof). The metal nitride, metal boride and/or metal fluorides may also be mixtures.

Also disclosed herein are methods of producing casings. Optionally, a curable elastomeric rubber is wrapped around a casing string having a pre-milled window in a wall of the casing string. The curable elastomeric rubbers are preferably wrapped as sheets or tape, sized in excess of the required dimensions around the pre-milled window. Optionally, an insert may be placed inside the casing string to prevent the collapse of the elastomeric rubber into the window before it is cured. The insert may be sprayed with a coating to prevent the elastomer from adhering to the insert.

Optionally, the curable elastomeric rubbers may be cured via the addition of sulfur or other equivalent curatives or accelerators that modify the polymer by forming crosslinks between individual polymer chains. Optionally, ovens or autoclaves may be used to cure the elastomeric rubbers by heating.

Optionally, a nylon layer is applied as a woven cloth, strips, or tape. Optionally, the nylon layer is applied wet, preferably moistened with water, to ensure a snug fit between the nylon layer and the underlying curable elastomeric layer, which is applied as a fluid. Optionally, winding machines may be used to wind the nylon around the elastomeric rubber layer. The winding machine places tension on the nylon during the winding process. After the elastomeric layer is cured, the nylon layer is optionally removed.

The aramid layer may be applied by any method known in the art. In certain embodiments, an aramid fiber layer may be applied using a pitch control winding system. In certain embodiments a pitch control winding system may be used to cross-wrap the cured elastomeric rubber layer or the nylon layer, if present, twice with the aramid twine.

Any method of producing a casing described herein optionally includes the step of applying binder to the portion of the outer surface to which the elastomeric rubber layer and aramid fiber layer are applied prior to applying the first elastomeric rubber layer to the outer surface.

A binder may be applied to the outer surface of the casing string by any suitable application method known in the art. As one example, the binder material may be applied, for example, by thermal or plasma spray onto the casing substrate. For plasma spray application, the powder is premixed and of a narrow particle size distribution. The coating provides a dense, hard coating that when used on metals is highly corrosion resistant and has excellent dielectric strength. The surface treatment appearance is rough textured from the deposition process providing increased surface area for subsequent seal coating (if desired) and polymer bonding.

The thickness of the binder may be controlled in the coating process as desired and can be relatively thin; a nominal thickness of 0.25 mm (0.010 in) generally is adequate. Other adequate and useful thickness ranges are from about 0.1 mm (0.0039 in) to about 5 mm (0.1969 in) (e.g. 0.23 mm (0.009 in), 1 mm-0.23 mm, 0.23 mm-5 mm). In still other aspects of the disclosure, the non-conductive metal oxide coating or treatment will have a thickness of about 0.17 mm (0.0066 in) to about 0.2 mm (0.0079 in), or 0.5 mm (0.0197 in) to about 5 mm (0.197 in), or in still other embodiments, about 1 mm (0.0394") to about 3 mm (0.1181").

FIG. 1 shows a well system 10 with a casing string assembly including a casing according to one embodiment of the present disclosure. The well system 10 includes a parent wellbore 12 that extends through various earth strata. The parent wellbore 12 includes a casing string 16 cemented at a portion of the parent wellbore 12.

The casing string 16 includes an casing 18 interconnected with the casing string 16. The casing 18 can include an opening 20 that is a pre-milled window in a wall 22 of a tubular body 24. A composite material (not shown) is located around the tubular body 24 such that the composite material is located over the opening 20 and over at least a portion of the outer surface of the tubular body 24. The casing 18 can be positioned at a desired location to form a branch wellbore 26 from the parent wellbore 12. The desired location can be an intersection 28 between the parent wellbore 12 and the branch wellbore 26. The casing 18 can be positioned using various techniques. Examples of positioning techniques include using a gyroscope and using an orienting profile.

Branch wellbore 26 is depicted with dotted lines to indicate it has not yet formed. To form the branch wellbore 26, a whipstock can be positioned in the inner diameter of the casing string 16 relative to the opening 20 of the casing 18 and below the intersection 28. For example, keys or dogs associated with the whipstock can cooperatively engage an orienting profile to anchor the whipstock to the casing string 16 and to orient rotationally an inclined whipstock surface toward the opening 20.

Cutting tools, such as mills and drills, are lowered through the casing string 16 and deflected toward the opening 20. The cutting tools mill through the opening 20 and the subterranean formation adjacent to the window to form the branch wellbore 26.

Figure 2:
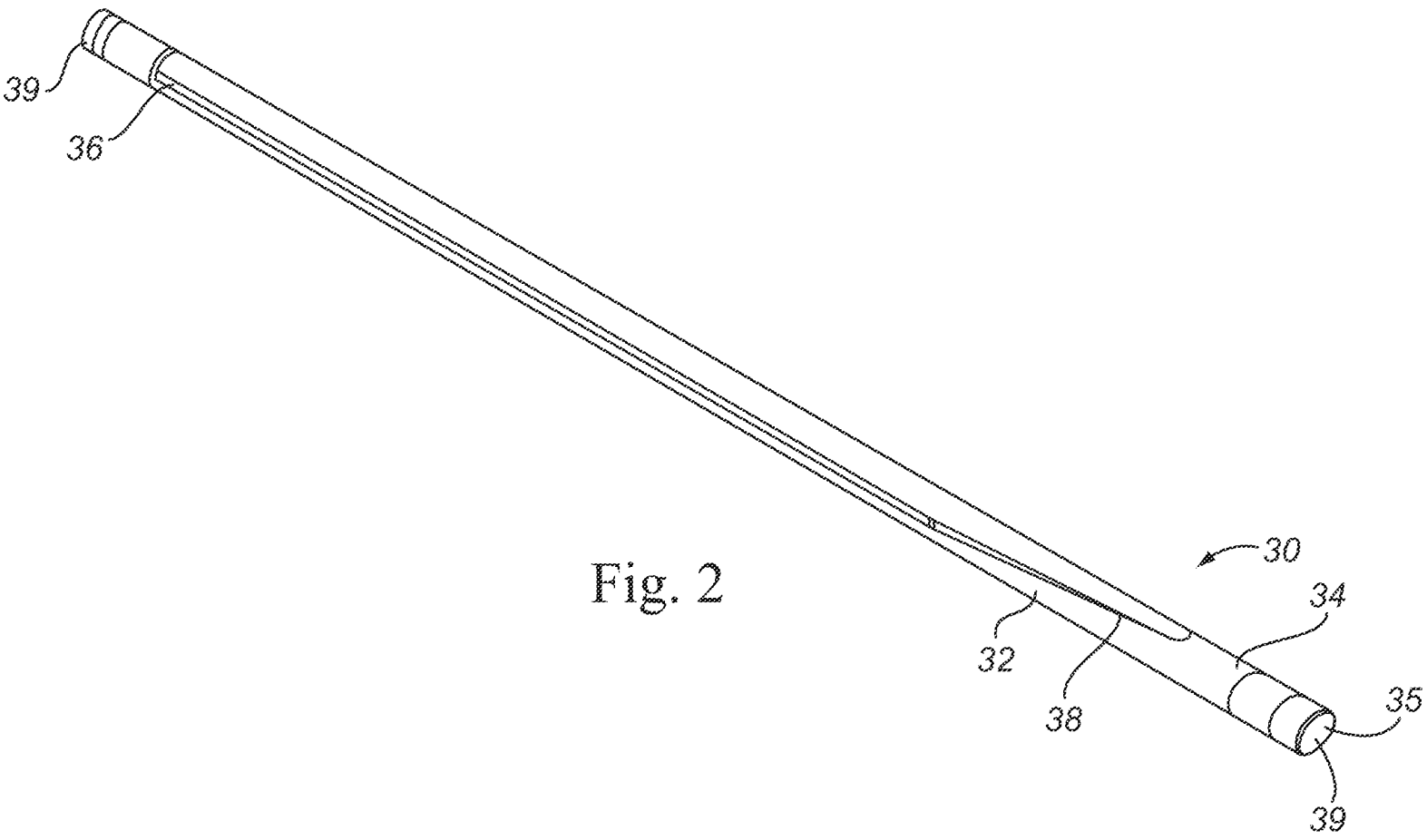
FIG. 2 is a perspective view of a casing according to one embodiment of the present disclosure.
Figure 3:
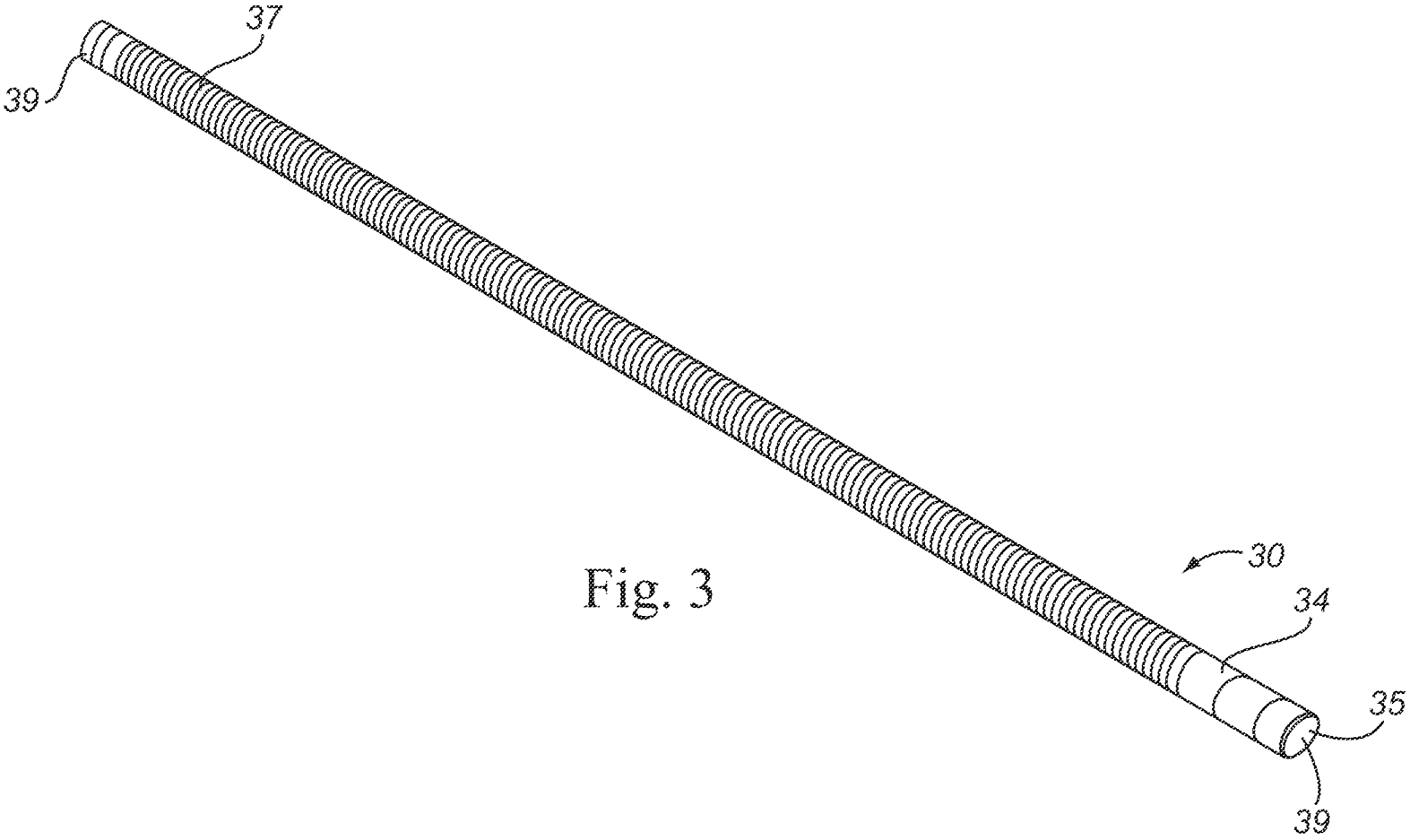
FIG. 3 is a perspective view of the casing of FIG. 2 including a composite material around the casing according to one embodiment of the present disclosure.

Casings according to various embodiments of the present disclosure can be in any desirable configuration to support branch wellbore formation and to interconnect with a casing string. FIGS. 2 and 3 depict a casing 30 according to one embodiment of the present disclosure that is capable of being interconnected with a casing string and disposed in a wellbore. The casing 30 includes a tubular body 32 that is made from a material that can be any material capable of retaining a general shape and integrity in a subterranean wellbore environment, including a high pressure and high temperature environment. In some embodiments, the tubular body 32 is made from a corrosion resistant alloy such as 13-chromium, 28-chromium, or other stainless steel or nickel alloy.

The tubular body 32 includes a generally tubular wall 34 that defines a central passage 35. The wall 34 has an opening 36 that is a pre-milled window through which a branch wellbore can be formed. FIG. 2 depicts the body prior to application of a composite material. FIG. 3 depicts the body with the composite material 37 located over the opening 36 and over at least a portion of the outer surface of the tubular body 32. The opening 36 is tapered at one end 38. The tapered shape may be configured to replicate, generally, the shape created when a window is milled by a round mill deflected from a whipstock and through the opening 36. The tapered shape can provide an easier path for tools to exit the window. The body 32 also includes end components 39 capable of interconnecting the assembly 30 to a casing string.

The composite material 37 may be coupled to the tubular body 32 by use of a bonding agent or binder (not shown) or any suitable device or method.

Figure 4:
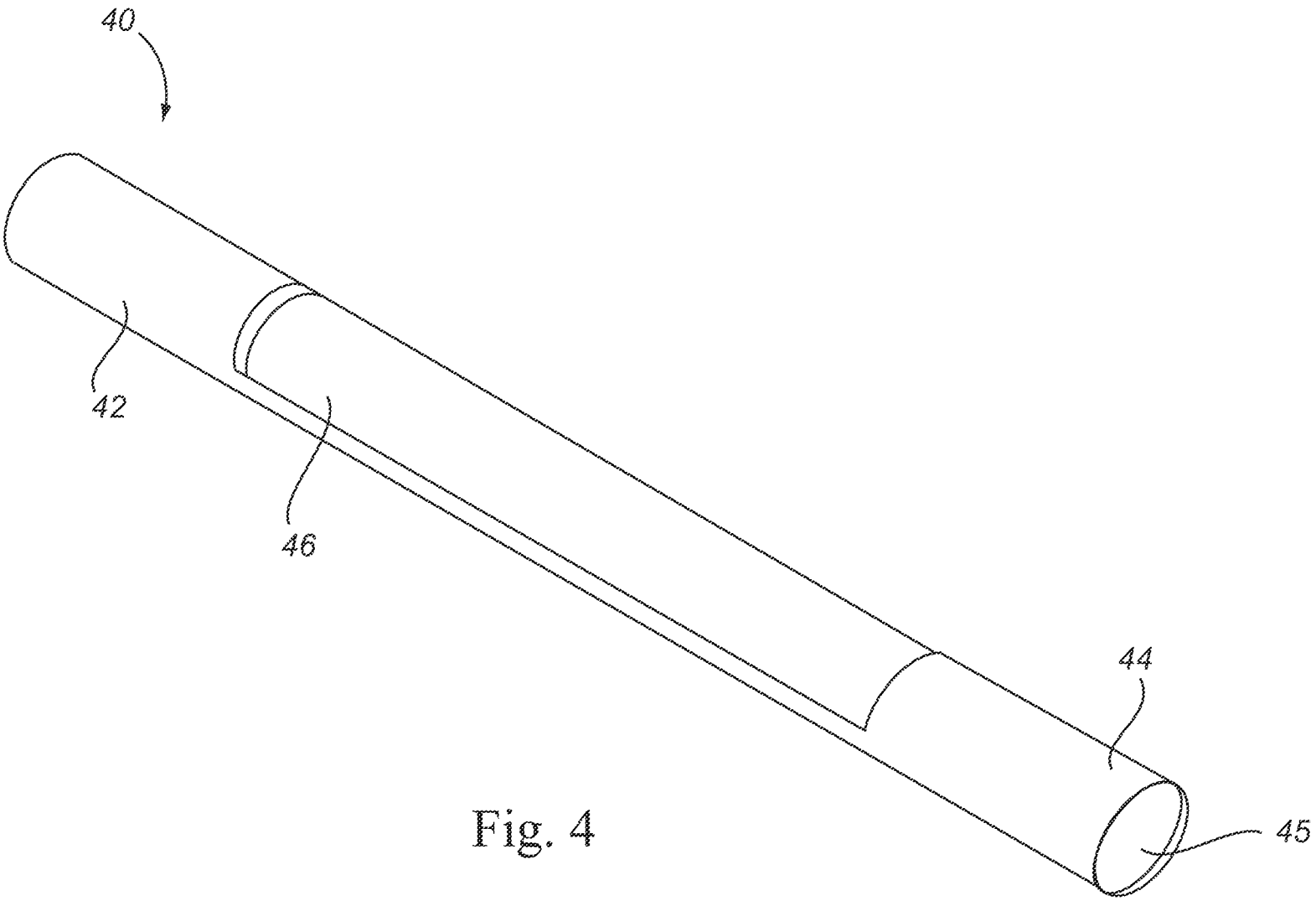
FIG. 4 is a perspective view of a casing according to one embodiment of the present disclosure.
Figure 5:
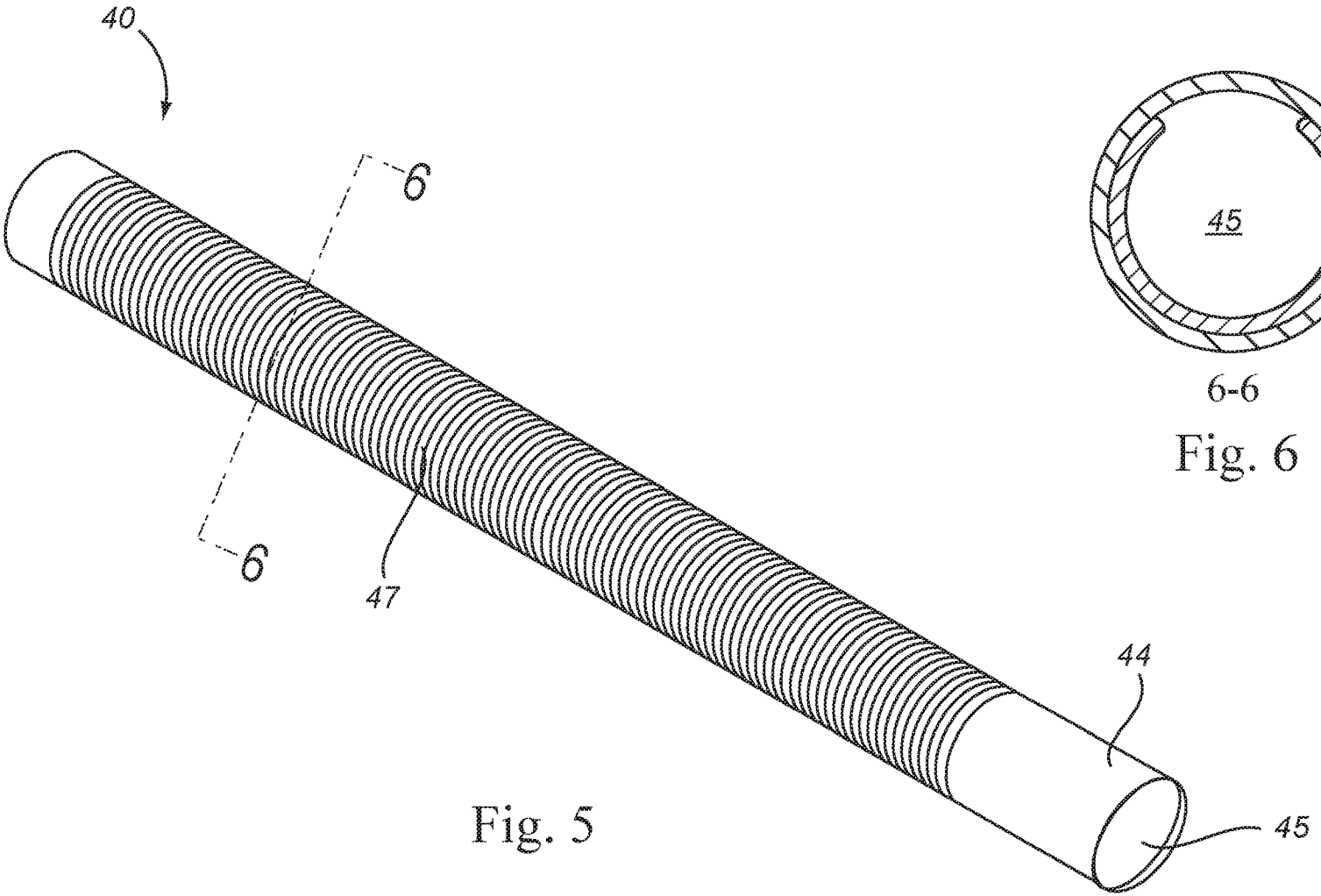
FIG. 5 is a perspective view of the casing of FIG. 4 including a composite material around the casing according to one embodiment of the present disclosure.

FIGS. 4 and 5 depict a casing 40 accordingly to a second embodiment of the present disclosure. The casing 40 can be interconnected with a casing string and disposed in a wellbore. The casing 40 includes a tubular body 42 that is made from any of the materials previously described as suitable for tubular body 32. The tubular body 42 includes a generally tubular wall 44 that defines a central passage 45. The wall 44 has an opening 46 that is a pre-milled window through which a branch wellbore can be formed. FIG. 4 depicts the body prior to application of a composite material 47. FIG. 5 depicts the body with a composite material located over the opening 46 and over at least a portion of the outer surface of the tubular casing 47.

In one embodiment of a completed casing, the composite material 47 is located over the opening 46 and over at least a portion of the outer surface of the tubular body 42. The opening 46 has a semi-circular cross-section shape and a generally rectangular surface shape, instead of a tapered shape as in FIGS. 2 and 3. The composite material 47 can be coupled to the tubular body 42 by use of a bonding agent or binder (not shown) or any suitable device or method.

Figure 6:
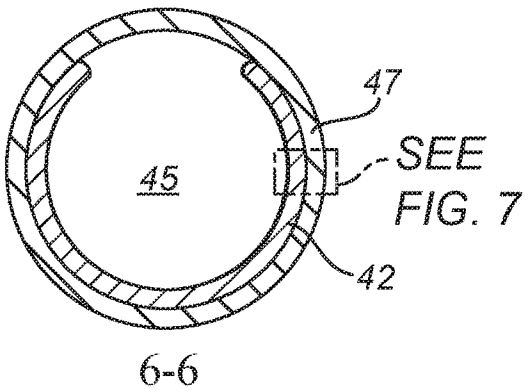
FIG. 6 is a cross-sectional view of the tubular casing of FIG. 5 along line 6-6 according to one embodiment of the present disclosure.
Figure 7:
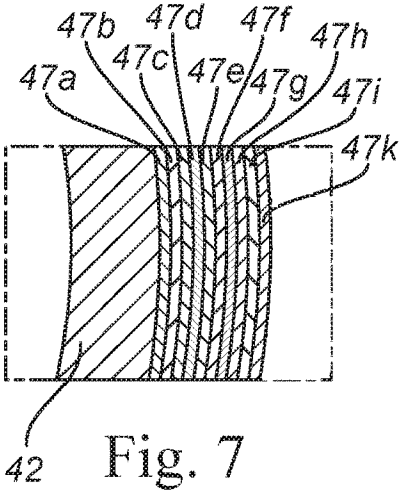
FIG. 7 is an enlarged view of a portion of the cross-sectional view shown in FIG. 6.

FIG. 6 is a cross-sectional view along line 6-6 in FIG. 5. The tubular body 42 is surrounded by the composite material 47. FIG. 7 is an enlarged view of a portion of the cross-sectional view shown in FIG. 6. FIG. 7 shows that composite material 47 including a first cured elastomeric rubber layer 47*a*, a first nylon layer 47*b*, a first aramid fiber layer 47*c*, a graphene layer 47*d*, second cured elastomeric rubber layer 47*e*, a second nylon layer 47*f*, a second aramid fiber layer 47*g*, third cured elastomeric rubber layer 47*h*, a third nylon layer 47*i*, and a third aramid fiber layer 47*k*.

In other examples, a composite material may omit one or more of the layers illustrated in FIG. 7, may include more than one graphene layer, or the graphene layer may be located elsewhere with respect to the other materials in the composite material.

Casings are depicted as including an opening in part of a circumferential portion of a body. Casings according to various embodiments can include openings of any size and shape.

Figure 8:
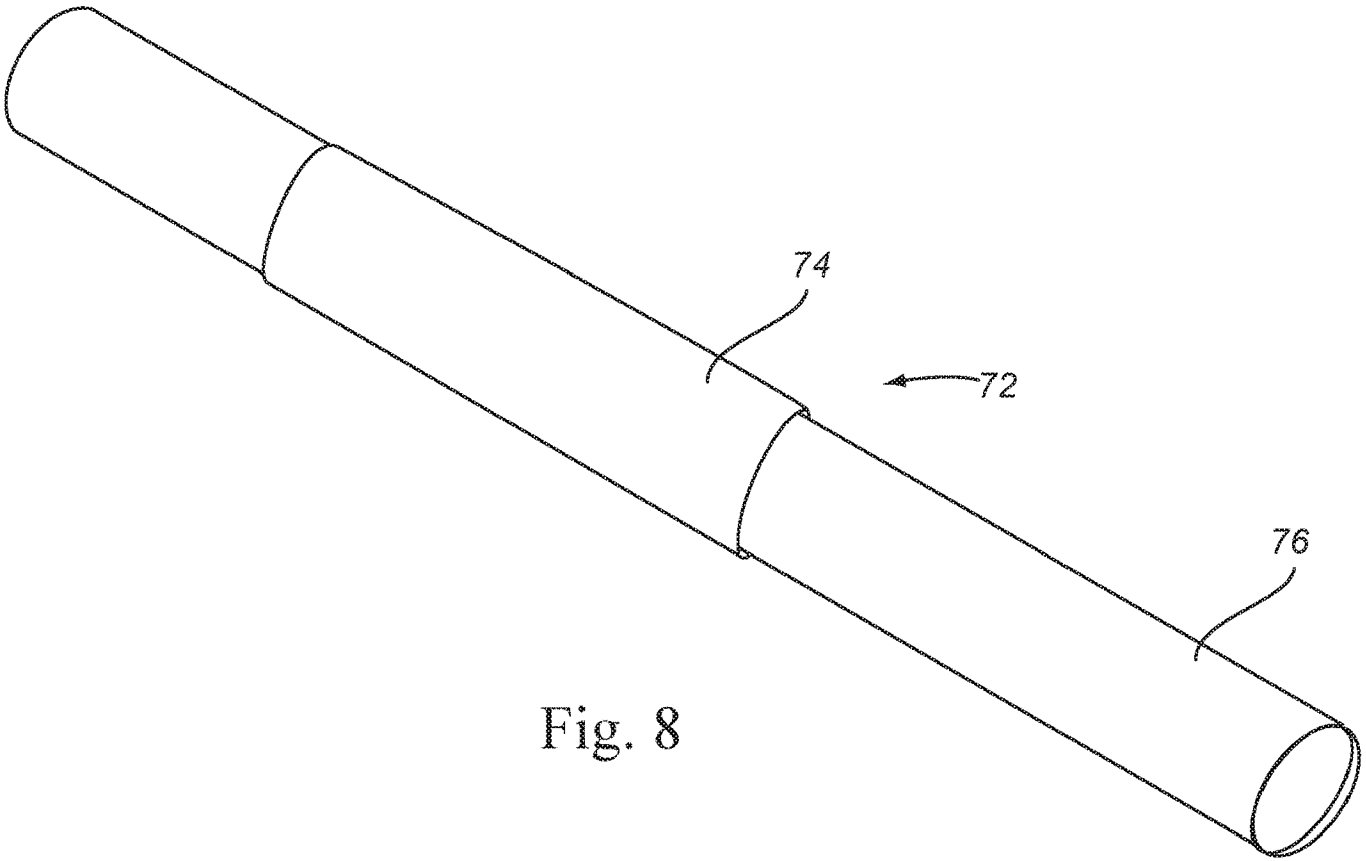
FIG. 8 is a perspective view of an assembly with a wear sleeve according to one embodiment of the present disclosure.

Various casings according to embodiments of the present disclosure can eliminate a requirement for a wear sleeve, liner, or other component that increases the outer diameter or the inner diameter of an assembly. Other casing embodiments include a liner and/or wear sleeve to increase the strength of a member of the assembly. FIG. 8 depicts a casing 72 that includes a wear sleeve 74 that is disposed exterior to a body 76 and located over a composite material (not shown) that is located over an opening (not shown) in a sidewall portion of the body 76.

The wear sleeve 74 can be made from any suitable material. Suitable materials include fiberglass, plastic, and combinations thereof. In embodiments, a wear sleeve may include graphene embedded in the fiberglass or plastic. Assemblies according to other embodiments may or may not include a wear sleeve.

Figure 9:
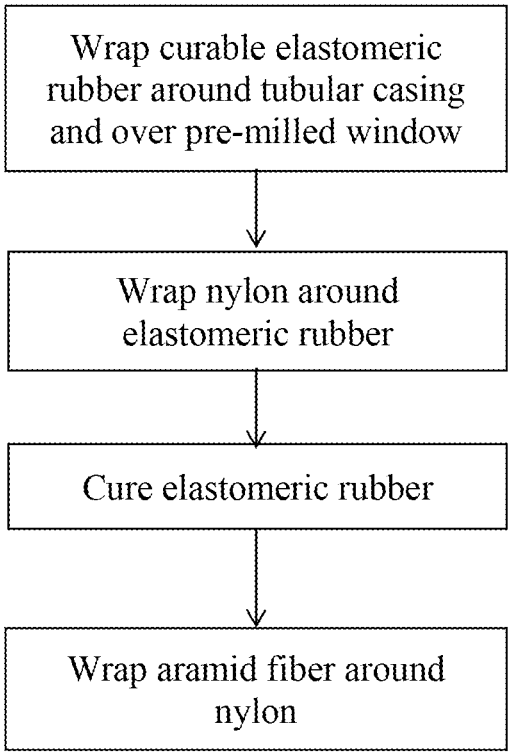
FIG. 9 is a flow chart illustrating one method of making a casing according to one embodiment of the present disclosure.

FIG. 9 is a flow chart illustrating one method of making a casing of the present disclosure. First a curable elastomeric rubber is wrapped around a tubular casing and over a pre-milled window. Then nylon is wrapped around the elastomeric rubber. The elastomeric rubber is cured. After the elastomeric rubber is cured, the nylon may optionally be removed. Finally, aramid fiber is wrapped around the nylon, or around the rubber if the nylon has been removed.

An assembly as described herein may include a casing string with a wall having an outer surface and an opening in the wall that is a pre-milled window. A composite material is disposed over and exterior to the opening and at least part of the outer surface. An assembly as described herein may have a wear sleeve disposed on the outer surface of the casing string and covering the composite material and the opening in the wall. The wear sleeve may have tabs to prevent rotation of the wear sleeve. Assemblies described herein also may include wrapping around one or both ends of the wear sleeve. The wrapping may be rubber, nylon or a combination thereof. The wrapping may prevent movement of the wear sleeve and also may assist in preventing leaks.

Assemblies according to some embodiments can reduce the load required on a casing string and can minimize the outer diameter of the casing string with a pre-milled window. For example, in one embodiment, a maximum outer diameter of a casing string with a pre-milled window may be 12.125 inches and the minimum outer diameter maybe 10.625 inches, providing 0.75 inches per side for a composite material to be located to cover a pre-milled window and a portion of the wall.

Accordingly, casing strings are provided according to one or more of the following examples:

Example #1

A casing, may include (i) a tubular body having a wall and a central passage, wherein the wall has an outer surface; (ii) at least one pre-milled window located in the wall for receiving a cutting tool such as a drill bit extending from the central passage; and (iii) a composite material disposed over the pre-milled window. The composite material may include a first cured elastomeric rubber layer, an optional first nylon layer on the first cured elastomeric rubber layer, and a first aramid fiber layer on the first cured elastomeric rubber layer or on the first nylon layer, if present. Optionally, the composite material is disposed over at least a portion of the tubular body. Optionally, the composite material surrounds the perimeter of the tubular body along a length at least sufficient for the composite material to cover the pre-milled window.

Example #2

The casing of Example #1 may feature a composite material that further includes a second cured elastomeric rubber layer on the first aramid fiber layer, an optional second nylon layer on the second cured elastomeric rubber layer, and a second aramid fiber layer on the second cured elastomeric rubber layer or on the second nylon layer, if present.

Example #3

The casing of Examples #1-2 may feature composite materials that include a third cured elastomeric rubber layer and that optionally may include a third nylon layer. The third cured elastomeric layer may be on the second aramid fiber layer and the third nylon layer, if present, may be on the third cured elastomeric rubber layer.

Example #4

The casing of Examples #1-3 may feature first aramid fiber layers that include twine wound around either the first cured elastomeric rubber layer or the first nylon layer. Optionally, the twine may be wound at a pitch of about 3/16 inch to about 1/4 inch to create twine windings having a pitch of 3/16 to 1/4 inch around the first cured elastomeric rubber layer or around the first nylon layer.

Example #5

The casing of Examples #1-4 may feature second aramid fiber layers that include twine wound around either the second cured elastomeric rubber layer or the second nylon layer. Optionally, the twine of the second aramid fiber layer may be wound substantially perpendicularly to the twine in the first aramid fiber layer.

Example #6

The casing of Examples #1-5 may feature composite materials that include a graphene layer. Optionally, the graphene layer is graphene paper (e.g. graphene nanopaper). Optionally, the graphene layer at least partially covers the pre-milled window.

Example #7

The casing of Examples #1-6 may feature elastomeric rubbers for the first, second, or third cured elastomeric rubber layer that include, but are not limited to, fluorocarbon elastomers.

Example #8

The casing of Examples #1-7 may further include a wear sleeve disposed on the outer surface of the tubular casing. Optionally, the wear sleeve includes fiberglass, plastic, or combinations thereof. Optionally, the wear sleeve may include graphene embedded in the fiberglass.

Example #9

The casing of Examples #1-8 may further include a binder material between the tubular casing and the composite material, on the outer surface of the tubular casing and in contact with the composite material. Optionally, the binder material includes a metal oxide.

Example #10

A casing string assembly may include the casing of any of Examples #1-9.

Example #11

A method of producing a casing may include (1) providing a tubular casing including a wall having an outer surface, a central passage, and at least one pre-milled window located in the wall for receiving a cutting tool extending from the central passage and (2) forming a covering over the pre-milled window and on the outer surface.

Example #12

The method of Example #11 may feature a forming step that includes applying a first curable elastomeric rubber layer over the pre-milled window and over at least a portion of the outer surface; applying a first nylon layer on the first elastomeric rubber layer, wherein the first nylon layer is optionally wet; curing the first curable elastomeric rubber layer to form a first cured elastomeric rubber layer; optionally, removing the first nylon layer; applying a first aramid fiber layer on the first cured elastomeric rubber layer.

Example #13

The method of Examples #11-12 may feature forming steps that include applying a second curable elastomeric rubber layer on the first aramid fiber layer; applying a second nylon layer on the second curable elastomeric rubber layer, wherein the second nylon layer is optionally wet; curing the second curable elastomeric rubber layer to form a second cured elastomeric rubber layer; optionally, removing the second nylon layer; applying a second aramid fiber layer on the second cured elastomeric rubber layer.

Example #14

The method of Examples #11-13 may feature forming steps that include applying a third curable elastomeric rubber layer on the second aramid fiber layer; applying a third nylon layer on the third curable elastomeric rubber layer, wherein the third nylon layer is optionally wet; curing the third curable elastomeric rubber layer to form a third cured elastomeric rubber layer; optionally, removing the third nylon layer.

Example #15

The method of Examples #11-14 may feature a forming step that includes applying one to three graphene layers over the pre-milled window. Optionally, a graphene layer may be applied over one or more of the elastomeric layers. Optionally, a graphene layer may be applied over one or more of the nylon layers. Optionally, a graphene layer may be applied over one or more of the aramid fiber layers.

Example #16

The method of Examples #11-15 may further include applying a binder to at least a portion of the outer surface of the casing string prior to applying the first elastomeric rubber layer to the portion of the outer surface. Optionally, the step of applying a binder may include thermal spraying.

Example #17

The method of Examples #11-16 may further include installing a wear sleeve on the tubular casing. Optionally, the wear sleeve may be held in place by any fastener, e.g., O-rings, tabs, epoxy, latching dogs, screws, rivits, rubber and/or nylon wrap, heat shrink, or any other fastener known in the art. Optionally, the wear sleeve is held in place by at least two O-rings.

Example #18

The method of Examples #11-17 may further include removing the composite material over the pre-milled window by drilling or milling through the composite material.

These illustrative examples are given to introduce the reader to the general subject matter discussed herein and are not intended to limit the scope of the disclosed concepts. The following sections describe various additional embodiments and examples with reference to the drawings in which directional descriptions are used to describe the illustrative embodiments but, like the illustrative embodiments, should not be used to limit the present disclosure.

As employed above and throughout the disclosure, the following terms, unless otherwise indicated, shall be understood to have the following meanings.

As used herein, the singular forms “a,” “an,” and “the” include the plural reference unless the context clearly indicates otherwise.

While the present disclosure is capable of being embodied in various forms, the description below of several embodiments is made with the understanding that the present disclosure is to be considered as an exemplification of the disclosure, and is not intended to limit the disclosure to the specific embodiments illustrated. Headings are provided for convenience only and are not to be construed to limit the disclosure in any manner. Embodiments illustrated under any heading may be combined with embodiments illustrated under any other heading.

The use of numerical values in the various quantitative values specified in this application, unless expressly indicated otherwise, are stated as approximations as though the minimum and maximum values within the stated ranges were both preceded by the word "about." In this manner, slight variations from a stated value can be used to achieve substantially the same results as the stated value. Also, the disclosure of ranges is intended as a continuous range including every value between the minimum and maximum values recited as well as any ranges that can be formed by such values. Also disclosed herein are any and all ratios (and ranges of any such ratios) that can be formed by dividing a recited numeric value into any other recited numeric value. Accordingly, the skilled person will appreciate that many such ratios, ranges, and ranges of ratios can be unambiguously derived from the numerical values presented herein and in all instances such ratios, ranges, and ranges of ratios represent various embodiments.

When ranges are used herein for physical properties, such as molecular weight, or chemical properties, such as chemical formulae, all combinations, and subcombinations of ranges specific embodiments therein are intended to be included.

Those skilled in the art will appreciate that numerous changes and modifications can be made to the preferred embodiments of the disclosure and that such changes and modifications can be made without departing from the spirit of the disclosure. It is, therefore, intended that the appended claims cover all such equivalent variations as fall within the true spirit and scope of the disclosure.

What is claimed is:

1. A casing comprising
- a tubular body having a wall defining a central passage, and an outer surface;
- at least one pre-milled window along the wall for receiving a cutting tool extending from the central passage;
- a composite material disposed over the pre-milled window, the composite material comprising
  - a first cured elastomeric rubber layer; and
  - a first aramid fiber layer on the first cured elastomeric rubber layer,
- a wear sleeve disposed on the outer surface of the tubular casing and over the composite material.

2. The casing of claim 1, wherein the composite material is disposed over at least a portion of the tubular body.

3. The casing of claim 1 wherein the composite material further comprises
- a second cured elastomeric rubber layer on the first aramid fiber layer; and
- a second aramid fiber layer on the second cured elastomeric rubber layer.

4. The casing of claim 3, wherein the composite material further comprises a third cured elastomeric rubber layer on the second aramid fiber layer.

5. The casing of claim 4, wherein at least one of the first, second, and third cured elastomeric rubber layer comprises fluorocarbon elastomer.

6. The casing of claim 1, wherein the composite material further comprises a first nylon layer between the first elastomeric rubber layer and the first aramid fiber layer.

7. The casing of claim 6, wherein the composite material further comprises a second nylon layer between the second cured elastomeric rubber layer and the second aramid fiber layer.

8. The casing of claim 7, further comprising a third nylon layer on the third cured elastomeric rubber layer.

9. The casing of claim 1, wherein the composite material further comprises at least one graphene layer at least partially covering the pre-milled window.

10. The casing of claim 1, wherein the wear sleeve comprises a material selected from the group consisting of fiberglass, plastic, and combinations thereof.

11. The casing of claim 1, further comprising a binder material between the tubular casing and the composite material, on the outer surface of the tubular casing and in contact with the composite material, wherein the binder material comprises a metal oxide.

12. A casing string assembly comprising the casing of claim 1.

13. A method of producing a casing, comprising:
- providing a tubular casing comprising:
  - a wall having an outer surface;
  - a central passage; and
  - at least one pre-milled window located in the wall for receiving a cutting tool extending from the central passage;
- forming a composite material over the pre-milled window and on the outer surface, the forming comprising:
  - applying a first curable elastomeric rubber layer over the pre-milled window and at least a portion of the outer surface;
  - applying a first nylon layer on the first elastomeric rubber layer;
  - curing the first curable elastomeric rubber layer to form a first cured elastomeric rubber layer;
  - applying a first aramid fiber layer; and
- installing a wear sleeve on the tubular casing.

14. The method of claim 13, wherein the forming further comprises
- applying a second curable elastomeric rubber layer on the first aramid fiber layer;
- applying a second nylon layer on the second curable elastomeric rubber layer;
- curing the second curable elastomeric rubber layer to form a second cured elastomeric rubber layer;
- applying a second aramid fiber.

15. The method of claim 14, wherein the forming further comprises
- applying a third curable elastomeric rubber layer on the second aramid fiber layer;
- applying a third nylon layer on the third curable elastomeric rubber layer;
- curing the third curable elastomeric rubber layer to form a third cured elastomeric rubber layer.

16. The method of claim 13, wherein the forming further comprises applying at least one graphene layer over the pre-milled window.

17. The method of claim 15, wherein the forming further comprises
- after curing the first curable elastomeric rubber layer, removing the first nylon layer before applying the first aramid fiber layer;

after curing the second curable elastomeric rubber layer, removing the second nylon layer before apply the second aramid fiber layer;

after curing the third curable elastomeric rubber layer, removing the third nylon layer.

18. The method of claim 13, further comprising applying a binder to at least a portion of the outer surface prior to applying the first elastomeric rubber layer to the portion of the outer surface.

19. The method of claim 18, wherein applying the binder comprises thermal spraying.

* * * * *